US005151055A

United States Patent [19]

Lumbis

[11] Patent Number: 5,151,055

[45] Date of Patent: Sep. 29, 1992

[54] SELF LOCKING ELECTRICAL CONTACT

[75] Inventor: Anthony W. Lumbis, Watertown, N.Y.

[73] Assignee: Knorr Brake Holding Corporation, Westminster, Md.

[21] Appl. No.: 776,883

[22] Filed: Oct. 17, 1991

Related U.S. Application Data

[63] Continuation of Ser. No. 402,731, Sep. 5, 1989, abandoned.

[51] Int. Cl.[5] ..... H01R 13/621

[52] U.S. Cl. ..... 439/784

[58] Field of Search ..... 439/346, 784, 801

[56] References Cited

U.S. PATENT DOCUMENTS

| | | | |
|---|---|---|---|
| 2,210,058 | 8/1940 | Blackburn | 439/784 |
| 2,673,971 | 3/1954 | Kacmar | 439/784 |
| 4,427,252 | 1/1984 | Lee et al. | 439/801 |
| 4,743,201 | 5/1988 | Robinson et al. | 439/10 |

FOREIGN PATENT DOCUMENTS

| | | | |
|---|---|---|---|
| 23295 | 7/1949 | Finland | 439/801 |

*Primary Examiner*—Gary F. Paumen

*Attorney, Agent, or Firm*—Barnes & Thornburg

[57] ABSTRACT

An electrical connector which comprises a first elongated connecting element and a second elongated connecting element, the first elongated element having a threaded surface along the exterior thereof, the second elongated connector having a shoulder thereon, and a compression nut extending around and against the shoulder of the second connecting element and engaging the first connecting element to force positive engagement between the first and second connecting elements. The apparatus may include structure the second elongated connecting element for selectively preventing axial movement of the compression nut past a predetermined axial point whereby the first and second elongated connecting elements are separated. The structure may include a generally diametrically extending bore in the second connecting element dimensioned for insertion of an associated pin to facilitate disassembly of the first and second connecting elements.

16 Claims, 1 Drawing Sheet

SELF LOCKING ELECTRICAL CONTACT

This is a continuation of application Ser. No. 07/402,731, filed Sep. 5, 1989, now abandoned.

BACKGROUND OF THE INVENTION

The invention relates to electrical couplings and particular to assemblies which are useful in the electrical coupling of railway car body wiring to an electrical coupler contact. The connection between cars is made by means of apparatus such as that shown in U.S. Pat. No. 4,743,201 assigned to the same assignee as the present invention. The present inventor was a co-inventor of that apparatus.

More specifically, the interconnection of electrical wires from one rail car to the next is achieved by means of connectors arranged in dielectric blocks which are forced together as by clamping. In one transit car design, electrical contact from one wire to another is achieved by means of a butt fit between a moveable contact plunger in one block and a stationary contact pen in another block at the connection interface. This electrical interface is in addition to mechanical coupling elements which hold the two railway cars together and thus hold the respective dielectric blocks on the respective cars in engagement.

Various means have been provided to couple the car body wiring to the electrical coupler contacts in the dielectric blocks. These include the following:

1. Pin and socket. This construction has the disadvantage that the contact force is dependent on the spring force of a split pin. More specifically, an axially split pin engages an elongated socket. More specifically, the pin, in a typical embodiment, is split axially in two planes disposed at right angels to each other. The axially extending segments of the pin are spring biased outwardly to engage the wall of the elongated socket somewhat in the manner of a banana plug. This rather poor connection tended to overheat due to vibration or large currents. The overheating would cause a loss of spring force which compounded the overheating problem resulting in a failure of the electrical connection.
2. Solder connection. This approach avoided the overheating problem but does not provide for ease of separability of the components.
3. Ring terminals. For some applications, commercially available ring terminals have been used. This method provides a low resistance separable connection. However, the physical size precludes usage in some applications. In addition, it may be difficult in some cases to provide adequate insulation of the entire connection while maintaining the separability feature.
4. Commercially available Sta-Kon (trademark) terminals. Some applications have used such commercially available male tab with a cooperating female connection. This construction can be easily insulated and requires little space, however, such connections are subject to loosening due to vibrations and are not at all suitable for a large current loads.

It is an object of the invention to provide a connection which provides a low contact resistance path between the train line wires and the coupler contacts and which is also easily separable.

Another object of the invention is to provide apparatus which is capable of carrying large current loads in excesss of 40 amperes continuously.

Still another object of the invention is to provide a novel and improved means of connecting the electrical wires of the railway car to that car's electrical coupler contacts with a minimal voltage drop across the connection while providing maximum reliability for apparatus which is easy to assemble and disassemble.

Another object of the invention is to provide apparatus which will lock together in a very positive manner.

Yet another object of the invention is to provide apparatus which can be easily disconnected despite the locking nature of the connection made by the apparatus.

Still another objection of the invention is to provide apparatus which will be substantially immune to ambient contaminants and the formation of an oxide coating or other film growth which would degrade the electrical connection.

SUMMARY OF THE INVENTION

It has now been found that these and other objects of the invention may be attained in an electrical connector which includes a first elongated connecting element and a second elongated connecting element. The first elongated connecting element has a threaded surface along the exterior thereof. The second elongated connector has a shoulder thereon. A compression nut extends around and against the shoulder of the second connecting element and engages the first connecting element to force positive engagement between the first and second connecting elements. Means is provided on the second elongated connecting element for selectively preventing axial movement of the compression nut past a predetermined axial point whereby the first and second elongated connecting elements are separated when the compression nut is disengaged from the first connecting element.

This embodiment of the apparatus in accordance with the invention may be characterized by a means on the second connecting element which includes a generally diametrically extending bore therein for insertion of an associated pin to facilitate disassembly of the first and second connecting elements.

This embodiment may have a means for meshing that includes at least one tapered element and the first elongated connecting element may include a central bore which may be axially tapered. More specifically, the second elongated connecting element may include an axially tapered member dimensioned and configured for engagement with the bore in the first elongated connecting element.

BRIEF DESCRIPTION OF THE DRAWING

The invention will be better understood by reference to the accompanying drawing in which.

DESCRIPTION OF THE PREFERRED EMBODIMENT

Figure 1:
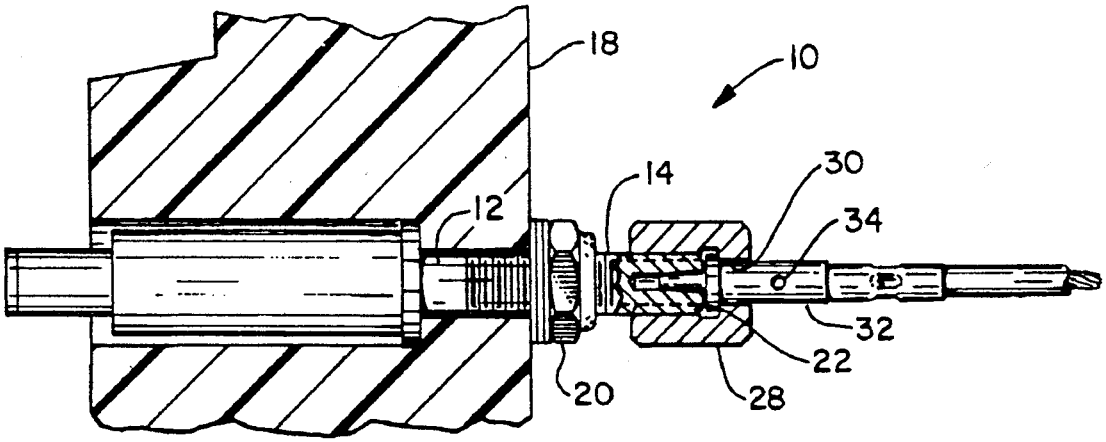
FIG. 1 is a side view in partial section of the mating first and second elongated connecting elements of the apparatus in accordance with a preferred embodiment of the invention.
Figure 2:
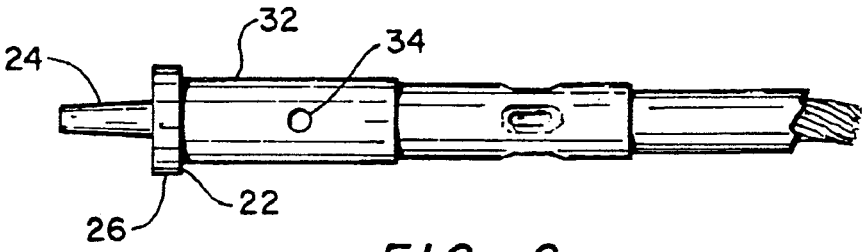
FIG. 2 is an enlarged side view of the second elongated connecting element.
Figure 3:
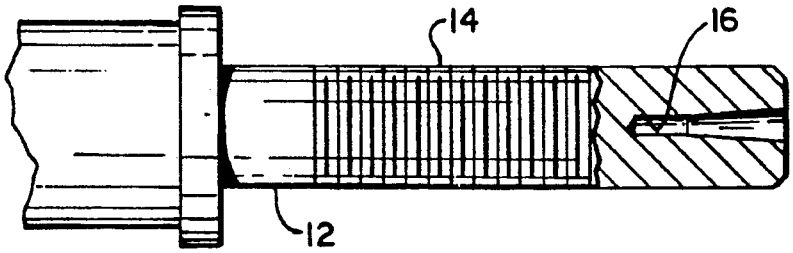
FIG. 3 is an enlarged side view of the first elongated connecting element.

Referring now to FIGS. 1–3 there is shown a self locking electrical connector 10 in accordance with one form of the invention. The apparatus includes a stud 12 which is elongated and provided with threads 14 along the exterior surface thereof which extend from the free end (the right end as viewed). The left most end (as viewed) of the stud 12 is secured in a dielectric block 18 by means of lock nut 20. It will be understood that the dielectric block 18 is a part of one electrical connector on one railway car that cooperates with another connector (not shown) on another railway car for electric connection between the respective railway cars.

The stud 12 is provided with a bore 16 which has an axial taper of approximately 0.05 inch per inch and a total length of ½ inch. Preferably, the bore 16 has only an axial portion thereof tapered. The maximum diameter is at the free end of the stud and is approximately 0.093 inch in one embodiment. The stud or rod 12 has a nominal diameter of ¼ inch and is approximately 2 inches long.

The stud 12 cooperates with a tapered pin 24 which has an axial extremity having a taper of approximately 0.05 inch per inch and a maximum diameter that results in an interference fit between the pin 24 and the bore 16. The seat 22 includes a shoulder 26 having a diameter of approximately 0.210 inch and which extends axially approximately 0.063 inch. A compression nut 28 has a bore allowing sliding engagement with the right most (as viewed) pin 32 of the second elongated connector 14 and the right most (as viewed) axial extremity of the shoulder 26.

It will be seen that as the compression nut 28 engages the threads 14 on the stud 12 that the left (as viewed) axial extremity of the seat 22 will be forced into engagement with the bore 16 in the stud 12 and further that the free end of the stud 12 will be disposed in end abutting relationship with the side of the shoulder 26 on the seat 22. Because of the taper referred to above and the interference fit also described above, the compression nut 28 will cause a very positive seating which will avoid the temperature build ups associated with some prior art constructions. The positive connection will also avoid the entrance of ambient contaminants which would, either directly interfere with the electrical connection, or indirectly interfere with the electrical connection by causing the formation of an oxide or other film which would also degrade the electrical connection.

Because of the interference/wedging fit between the connecting elements it is very difficult to separate the connecting elements. Pin 32 extends from the right (as viewed) side of the shoulder 26. The compression nut 28 slides freely along the pin 26.

The pin 26 is provided with a diametrically extending hole 34 to facilitate ease of disconnection between the seat 22 and the stud 12. More particularly, disassembly is accomplished by inserting a wire or other small pin (not shown) in the hole 34 of the pin 32 and then backing the compression nut 28 off from the threads 14 on the stud 12. As the right (as viewed) extremity of the compression nut 28 abuts the wire extending through the hole 34 of the pin 32 it forces the pin 32, seat 22 and axial extremity 24 away from the stud 12. In other words, the very tight locking connection between the seat 22 and axial extremity 24 with the stud 12 is easily broken by the backing off of the compression nut 28. Thus, the invention has the advantages of a very positive engagement which is easy to obtain as well as a great ease of disassembly.

Although the preferred embodiment of the invention has been described in terms a pin or wire that is inserted in a hole 34, it will be understood that other stop means may be used in various forms of the invention. For example, a stop that clamps onto the pin 32 could achieve a similar effect.

It will also be understood that in alternate embodiments the location of the male and female threads may be reversed without departing from the spirit of the invention.

The invention has been described with reference to its illustrated preferred embodiment. Persons skilled in the art of such devices may upon exposure to the teachings herein, conceive other variations. Such variations are deemed to be encompassed by the disclosure, the invention being delimited only by the appended claims.

Having thus described my invention I claim:

1. An electrical connector which comprises:

a first elongated connecting element and a second elongated connecting element, said first elongated connecting element having a threaded surface along the exterior thereof, said second elongated connecting element having a shoulder thereon;

a compression nut extending around and against said shoulder of said second connecting element and engaging said first connecting element to force positive engagement between said first and second connecting elements; and selection means for selectively allowing and preventing axial movement of said compression nut relative to said second elongated connecting element past a predetermined axial point on said second elongated connecting element without movement of a conductor mounted to said second elongated connecting element relative to said second elongated connecting element whereby said first and second elongated connecting elements are separated when said compression nut is disengaged from said first connecting element and said selection means prevents said axial movement.

2. The apparatus as described in claim 1 wherein:

said selection means includes a generally diametrically extending bore therein and a pin for insertion therein to prevent said axial movement and facilitate disassembly of said first and second connecting elements.

3. The apparatus as described in claim 1 including means meshing said first and second connecting elements for locking engagement.

4. The apparatus as described in claim 3 wherein:

said means for meshing includes at least one tapered element.

5. The apparatus as described in claim 4 wherein:

said first elongated connecting element includes a central bore.

6. The apparatus as described in claim 5 wherein:

said central bore is axially tapered.

7. The apparatus as described in claim 6 wherein:

said one tapered element is axially tapered and is dimensioned and configured for engagement with said bore in said first elongated connecting element.

8. The apparatus as described in claim 3 wherein:

said selection means includes a generally diametrically extending bore therein and a pin for insertion therein prevent said axial movement and facilitate disassembly of said first and second connecting elements.

9. An electrical connector which comprises:

a first elongated connecting element and a second elongated connecting element, said first elongated connecting element having a threaded surface along the exterior thereof, said second elongated connecting element having a shoulder thereon, a compression nut slidable on said second elongated connecting element and having a first position on said second elongated connecting element extending around and against said shoulder of said second elongated connecting element and engaging said first elongated connecting element to force interfering engagement between said first and second elongated connecting elements; and selection means for selectively allowing and preventing, axial movement of said compression nut past a second position on said second elongated connecting element displaced axially from said first position without movement of a conductor mounted to said second elongated connecting element relative to said second elongated connecting element whereby said first and second elongated connecting elements are separated when said compression nut is disengaged from said first elongated connecting element and said selection means prevents axial movement past said second position.

10. The apparatus as described in claim 9 wherein:

said selection means includes a generally diametrically extending bore therein and a pin for insertion therein prevent said axial movement and facilitate disassembly of said first and second connecting elements.

11. The apparatus as described in claim 9 including means meshing said first and second connecting elements for locking engagement.

12. The apparatus as described in claim 11 wherein:

said means for meshing includes at least one tapered element.

13. The apparatus as described in claim 12 wherein:

said first elongated connecting element includes a central bore.

14. The apparatus as described in claim 13 wherein:

said central bore is axially tapered.

15. The apparatus as described in claim 14 wherein:

said one tapered element is axially tapered and is dimensioned and configured for engagement with said bore in said first elongated connecting element.

16. The apparatus as described in claims 11 wherein:

said selection means includes a generally diametrically extending bore therein and a pin for insertion therein prevent said axial movement and facilitate disassembly of said first and second connecting elements.

* * * * *